US005820259A

United States Patent [19]

Cummins et al.

[11] Patent Number: 5,820,259

[45] Date of Patent: Oct. 13, 1998

[54] DUAL CONTROL MIXING JET COOKER

[75] Inventors: Richard D. Cummins, Orchard Park; Jack A. Perry, Lewiston, both of N.Y.

[73] Assignee: Q-Jet DSI, Inc., Lewiston, N.Y.

[21] Appl. No.: 935,922

[22] Filed: Sep. 23, 1997

Related U.S. Application Data

[63] Continuation of Ser. No. 688,495, Jul. 30, 1996, Pat. No. 5,743,638.

[51] Int. Cl.[6] ..... B01F 15/02

[52] U.S. Cl. ..... 366/163.2; 366/150.1; 366/167.1; 366/182.1; 261/DIG. 76; 261/76

[58] Field of Search ..... 366/101, 150.1, 366/163.2, 173.1, 176.1, 176.2, 182.1, 182.3, 182.4, 341; 261/76, DIG. 76

[56] References Cited

U.S. PATENT DOCUMENTS

| | | | |
|---|---|---|---|
| 2,202,573 | 5/1940 | Coppock . | |
| 3,133,836 | 5/1964 | Winfrey et al. . | |
| 4,023,355 | 5/1977 | McDonald . | |
| 4,312,701 | 1/1982 | Cambell | 162/4 |
| 4,442,047 | 4/1984 | Johnson . | |
| 4,732,712 | 3/1988 | Burnham et al. . | |
| 4,773,827 | 9/1988 | Zaiser | 417/183 |
| 4,856,558 | 8/1989 | Kardos . | |
| 4,886,368 | 12/1989 | King . | |
| 4,994,242 | 2/1991 | Rae et al. . | |
| 5,012,841 | 5/1991 | Kueffer . | |
| 5,622,655 | 4/1997 | Cincatta et al. | 261/DIG. 76 |

FOREIGN PATENT DOCUMENTS

| | | | |
|---|---|---|---|
| 1128095 | 1/1957 | France | 366/150.1 |
| 1129517 | 1/1957 | France | 366/167.1 |

*Primary Examiner*—Tony G. Soohoo
*Attorney, Agent, or Firm*—Sofer & Haroun, LLP.

[57] ABSTRACT

A fluid mixing apparatus for mixing a first fluid with a second fluid is provided. The fluid mixing apparatus includes a first housing, a second housing, a first actuator corresponding with the first housing, and a second actuator corresponding with the second housing. The first housing is provided with an inlet for supplying a first fluid such as water in the form of steam, and a nozzle outlet attached to a nozzle end of the first housing. The second housing is coupled to the nozzle end of the first housing and includes a inlet for supplying a second fluid such a slurry. A mixing tube, which may be slidable, is contained within the second housing for mixing the first fluid and the second fluid therein before passing the mixture out of the second housing. Alternatively, collar member may be circumferentially mounted around a stationary mixing tube contained in the second housing, or alternatively, around the nozzle outlet of the first housing. Depending upon whether the mixing tube is slidable, or where collar member is mounted if utilizing a stationary mixing tube, a circumferential gap is created between nozzle outlet and the collar member when the collar member is mounted on the mixing tube, and between the mixing tube and the collar member when the collar member is mounted on the nozzle outlet. The sliding mixing tube or collar member is made adjustable via a second actuator which is capable of adjusting the sliding mixing tube or the collar member so as to narrow or widen the gap and to control the pressure of the second fluid introduced into the mixing tube.

15 Claims, 5 Drawing Sheets

DUAL CONTROL MIXING JET COOKER

RELATED APPLICATIONS

This is a continuation of U.S. patent application Ser. No. 08/688,495, filed Jul. 30, 1996, U.S. Pat. No. 5,743,638.

FIELD OF THE INVENTION

The present invention is directed to a dual control mixing jet cooker. More particularly, the invention provides an improved fluid mixer for mixing a first fluid with a second fluid by independently controlling the pressurization of both first and second fluids.

BACKGROUND OF THE INVENTION

The present invention is directed to actuator-controlled mixing jet cookers for use in the heating and processing of liquids and slurries. Food production techniques frequently rely to a great extent upon the application of heat, either in the form of a flame or in the form of steam, to warm, cook, or purify a food product being produced. It was discovered early on that the application of steam to a food slurry or liquefied food form causes the slurry or food form to become "cooked" and thus safe for consumption and/or production and sale. As industry and machinery developed, devices where produced within which massive quantities of liquid or slurry were processed by transporting the liquid or slurry from a starting point to an end point, between which purifying, cooking, heating, mixing and other processes occurred. Eventually, fluid mixer and heat exchange devices were developed within which an entering slurry or liquid could be mixed, and heated or cooked simultaneously before being passed along to its next stage of processing or production.

U.S. Pat. No. 2,202,573 to Coppock discloses an early mixing jet cooking device. The Coppock device is comprised of a single orifice steam ejector used for pasting starch as a first liquefaction step in alcohol production. Using the Coppock device, a continuous stream of steam was mixed with the liquid or slurry, which generally comprised an amylaceous material such as flour, maize or potato starch in suspension in water in the form of a continuous stream. The two streams being so set or regulated that the mixture was entirely converted by the heat into starch paste of requisite consistency which was continuously used or collected as such. The Coppock device was comprised of a vertical cylindrical chamber through the top of which a downwardly converging steam nozzle is projected for supplying steam from a pipe controlled by a valve. The steam nozzle extends proximate the mouth of a downwardly divergent delivery nozzle coaxial with the steam nozzle and which projects upwardly inside the chamber from the base and continuing in the form of a delivery pipe. At the point where the steam nozzle and the delivery nozzle met, a flour suspension feed chamber was laterally connected for supplying the flour suspension into the path of steam provided by the steam nozzle. The flour then becomes cooked by the heat of the steam which condenses and the paste collects in a steadying chamber and is finally passed out through an exit pipe. Although adjustments to the nozzles and chamber of the Coppock device are possible, a complete shutdown of the process was required to enable the adjustments to be made.

More recent mixing jet cooking devices, such as those produced by Q-JET® or the Hydro-Heater™ produced by Hydro-Thermal Corporation, continue to utilize separate steam and liquid/slurry inlets, often having attached valves to control the inflow of steam or liquid/slurry, respectively. An actuator connected to the cooking device provides the steam jet which enters the cooking device. The steam and liquid inlets converge in a "combining" or "mixing" tube, which is an open ended cylinder through which the stem jet shoots. Between the open end of the cylinder and the skirt of the steam jet nozzle is a gap which permits the liquid or slurry to be drawn into the tube where it mixes with the jet of steam, is heated, and then pushed out the cooker outlet at the far end of the tube.

It has been found that varying and controlling the width of the gap between the steam nozzle and the mixing tube entry is essential for changing the pressure drop of the liquid flowing through the gap, and thereby control the final pressure at the cooker outlet. Prior art mixing jet cookers such as the Hydro-Heater™ vary and control the width of the gap through the utilization of a moveable mixing tube which require two or more seals on the tube, and which is axially slidable within the device for varying and controlling the width of the gap by moving the mixing tube towards or away from steam nozzle depending upon whether it is desired to widen or narrow the gap. The slidable mixing tube is generally provided with internal "O" ring seals on each end or with a flat plate and gasket seal. The "O" ring seals on the end of the slidable mixing tube are generally plagued by jamming due to adhesion by the dehydrating partially pasted adhesives which are mixed with the slurry, and to solids settling out of the slurries being heated therein. Although the sliding mixing tube which is sealed by the flat plate and gasket does not utilize any "O" rings, the seal is cumbersome and must be loosened in order to make adjustments to the connection between the mixing tube and the steam jet nozzle. Additionally, since these seals are internal, the cleaning of both of these types of seals can be a burdensome task. Furthermore, the slidable mixing tube is generally disposed within a housing and fixedly attached to the housing. In order to slide the mixing tube so as to widen or narrow the gap, the the cooking and heating process must first be halted so that the mixing tube may be manually moved. Halting the cooking and heating process substantially slows down the production process, requires additional manpower, and also leads to potential contamination of the slurry as the housing is opened to adjust the mixing tube.

None of the prior art devices, however, comprise a slidable mixing tube disposed within a housing and controlled by an adjustment rod closely mounted on the external of the housing and which extends parallel to the mixing tube within the housing, such that the slidable mixing tube may be controlled from the outside without having to halt the production process. Additionally, none of the prior art devices comprise a stationary mixing tube capable of varying and controlling the width of the gap between the nozzle and the mixing tube entry utilizing a collar rotatably mounted over either the outside diameter of the mixing tub or over the outside diameter of an extension of steam jet nozzle, the collar being controlled by a second actuator independent from the steam supplying actuator. Furthermore, none of the prior art devices utilize seals of the type which are self-wiping and which are easily removed for cleaning or replacement. As such, none of the prior art devices provide for independent control of the mixing tube to steam nozzle gap by remote equipment which eliminates shutdown of the production process in order to make adjustments to the mixing tube so as to change the size of the gap, as well as to make repairs.

OBJECTS AND SUMMARY OF THE INVENTION

Accordingly, it is a general object of the present invention to provide a dual actuator mixing jet cooker having an actuator adjustable mixing tube collar for varying and controlling the width of the gap between the steam jet nozzle and the mixing tube entry.

A more specific object of the present invention is to provide a dual actuator mixing jet cooker wherein a remote actuator independently controls the movement of the mixing tube, or of a collar mounted on the end of the mixing tube or a collar mounted on the end of the nozzle extension so as to vary and control the width of the gap between the steam jet nozzle and the mixing tube entry so as to change the pressure drop of the liquid or slurry flowing through the gap and thereby control the final pressure at the cooker outlet.

It is a further object of this invention to provide a dual actuator mixing jet cooker having an adjustment rod mounted to the mixing tube or the collar for adjusting the width of the gap between the steam jet nozzle and the mixing tube entry from the exterior.

It is an additional object of this invention to provide a dual actuator mixing jet cooker having an adjustment rod which is provided with one "O" ring seal, and which is self-wiping and easily removable.

In accordance with the present invention, a dual actuator mixing jet cooker is provided having a steam supply port, a first actuator for supplying the steam in the form of a steam jet, and a slurry supply port. The steam supply port is provided with a nozzle extending downward and coaxial into a mixing tube wherein a gap or annulus is created therebetween. A second independent adjustment actuator is provided for varying and controlling the width of a gap formed between the nozzle of the steam port and the entry opening end of the mixing tube. Since the mixing tube of the present invention is preferably stationary one, a collar is provided which may be mounted on the cylindrical end portion of the steam jet nozzle extension, or alternatively may be mounted on the open entry end of the mixing tube and is controlled by the independent adjustment actuator. Since the mixing tube is stationary, no seal is required on the collar. Rather, a Teflon coating or Teflon coated ring provides sufficient sealant qualities to the collar. By way of the adjustment actuator, the collar is caused to rotate open or closed so as to widen or narrow the gap between the open entry end of the mixing tube and the steam jet nozzle extension. A stationary mixing tube may also be provided which may be slidably controlled by the independent adjustment actuator.

The slurry supply port preferably permits the introduction of slurry into the mixing tube at a point downstream from the entry end opening. In this manner, steam provided by the steam supply port interacts and mixes with the slurry entering the mixing tube. The gap between the open entry end of the mixing tube and the end of the jet nozzle extension permits the slurry to be drawn into the mixing tube for the purpose of mixing with the steam jet to heat the slurry before being pushed out the exit end of the tube to the cooker outlet.

The dual actuator mixing jet cooker of the present invention enables dual control dispersion and hydration of water based adhesives and colloids at elevated temperatures by mixing and pressure cooking with direct steam injection. The dual actuator mixing jet cooker of the present invention is optimally designed for applications in the chemical process industry including the processing of food, candies and alcohol, as well as pulp and paper, pharmaceutical, textile and oil, gas and petrochemical processing.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings in which like reference characters denote similar elements throughout the several views.

DETAILED DESCRIPTION OF THE PRESENTLY PREFERRED EMBODIMENTS

Figure 1:
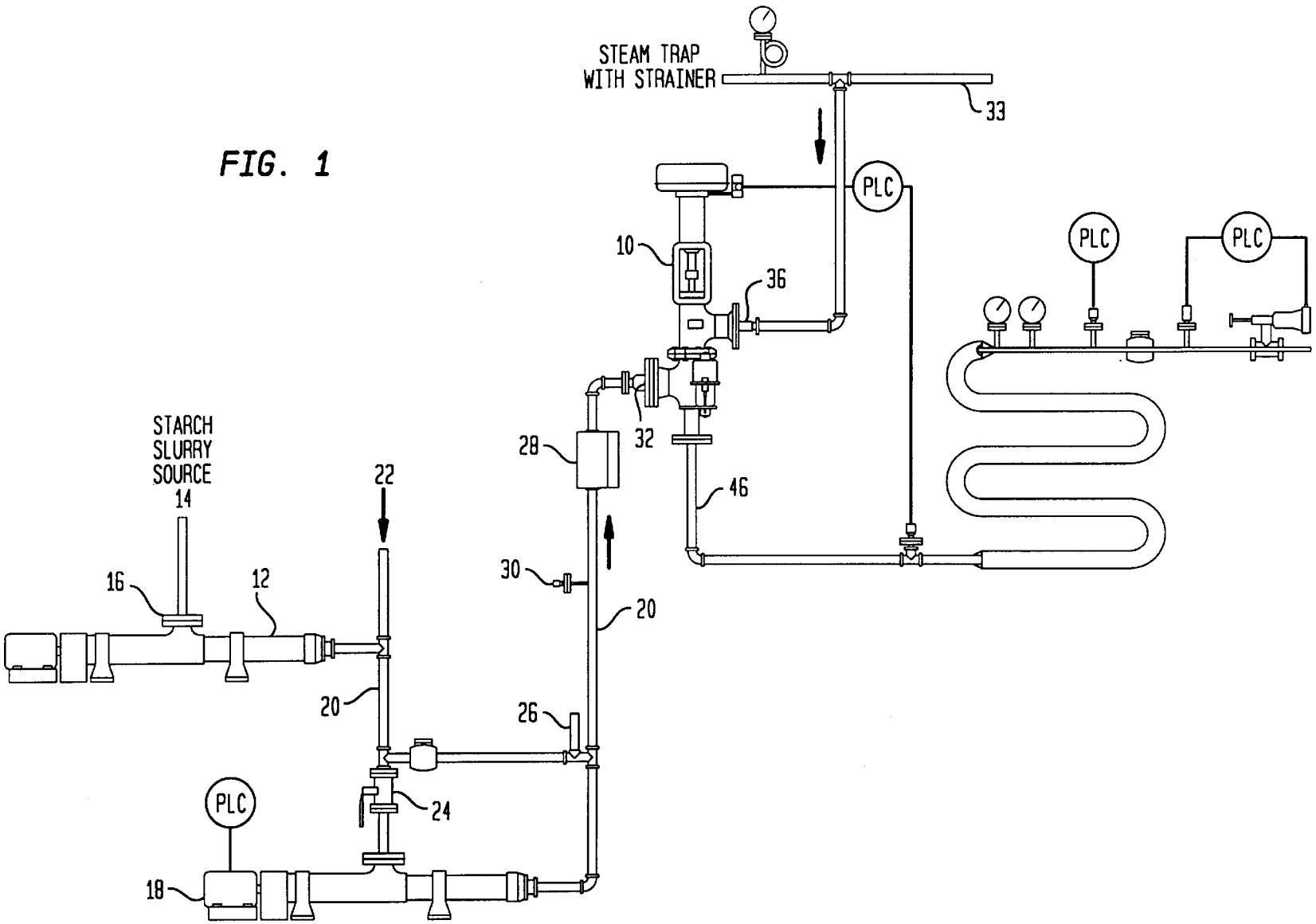
FIG. 1 is a schematic representation of the cooking process utilizing the dual actuator mixing jet cooker of the present invention.

The dual actuator mixing jet cooker of the present invention is optimally designed for a multitude of applications in the chemical process industry including, but not limited to, the processing of food, candies and alcohols, as well as pulp and paper, pharmaceutical and petrochemical processing. With initial reference to FIG. 1, there is provided solely for the illustrative purpose of describing the process in which the device of the invention functions, a schematic illustration which traces a typical commercial process for the enzymatic liquefaction of amylose starch as the first step in the production of ethyl alcohol. The process commences with the introduction of an enzyme slurry 12 from an enzyme slurry source 14. Enzyme injection pump 16 and progressing cavity positive displacement slurry pump 18 transport enzyme slurry 12 along a uni-directional integrated flow cavity path 20. As enzyme slurry 12 flows toward a dual actuator mixing jet cooker 10, a second slurry supply source 22 may add additional ingredients to the enzyme slurry 12 such as starch, sugar, water, or numerous other ingredients depending upon the product being produced. As the enzyme slurry 12 is flowing through cavity path 20, a series of valves such as pump isolation ball valve 24 for preventing backflow of enzyme slurry 12, and pump over pressure relief valve 26 for maintaining and controlling the pressure of the enzyme slurry 12 as it flows through cavity path 20. Enzyme slurry 12 passes through magnetic flowmeter 28, pressure transducer 30 and slurry backflow prevention check valve 32 which leads to dual actuator mixing jet cooker 10. As enzyme slurry 12 enters cooker 10, saturated high pressure steam 33 supplied by a steam supply (not shown) enters cooker 10 via steam supply port 36. The steam mixes with enzyme slurry 12 and cooks slurry 10 resulting in a paste which is then passed out of cooker 10 via an exit end 46 en route to the next step in the production process. It is to be understood that the process heretofore described my be altered depending on the product being produced, for example, more valves may be required or additional products added to the slurry. Alternatively, some products may not require all the elements recited above, for instance, certain food products may not require a magnetic flowmeter 28 or may not utilize an enzyme/starch slurry but may substitute other ingredients.

Figure 2:
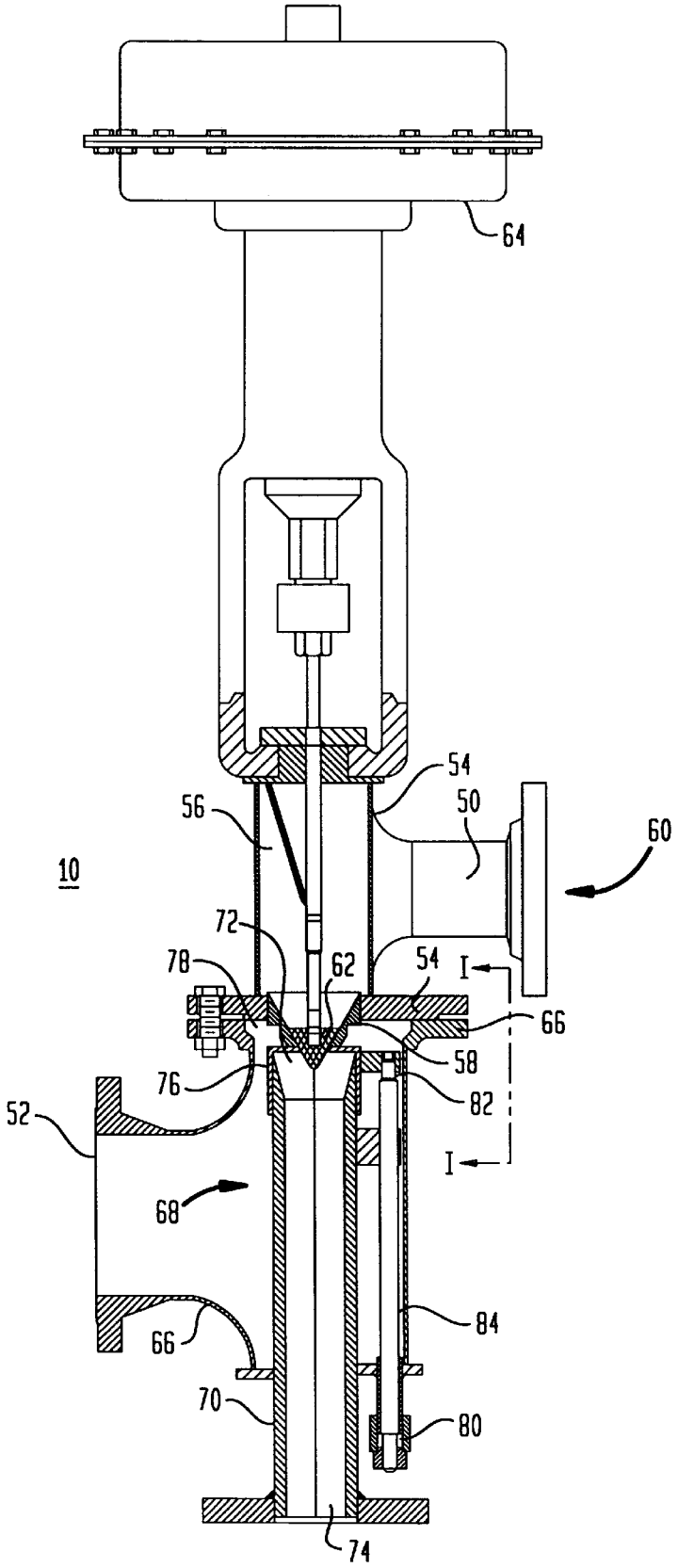
FIG. 2 is an elevational view of one embodiment of the dual actuator mixing jet cooker of the present invention having an axially movable collar mounted on the entry end of the mixing tube for controlling the gap between the steam jet nozzle extension and the mixing tube.

FIG. 2 illustrates the internal workings of a first embodiment of the fluid mixing apparatus of the present invention, known as a dual actuator mixing jet cooker 10, for mixing a first fluid 50, generally steam, and with a second fluid 52, which may be a liquid or a slurry mixture. The cooker 10 which preferably extends vertically to facilitate the passage of a fluid or slurry 52 therethrough, is comprised of a first housing 54 having an entry end and a nozzle end 58 although any orientation relative to a horizontal axis may be utilized. The first housing 54 further comprises a first fluid supply inlet 60 and a nozzle valve 62 or stem at nozzle end 58 of first housing 54. A first actuator means 64 is provided for controlling the exit rate or exit pressure of the first fluid 50 which generally exits from nozzle end 58 after passing through first housing 54. Such a first actuator 64, which controls the exit rate of fluid 50 may be of the type manufactured by Fisher Controls U.S.A. A second mixing housing 66 having a second fluid supply inlet 68 is coupled to the first housing 54 at its nozzle end 58. Within second housing 66, a stationary mixing tube 70 is disposed within which first fluid 50 and second fluid 52 are mixed.

Figure 3:
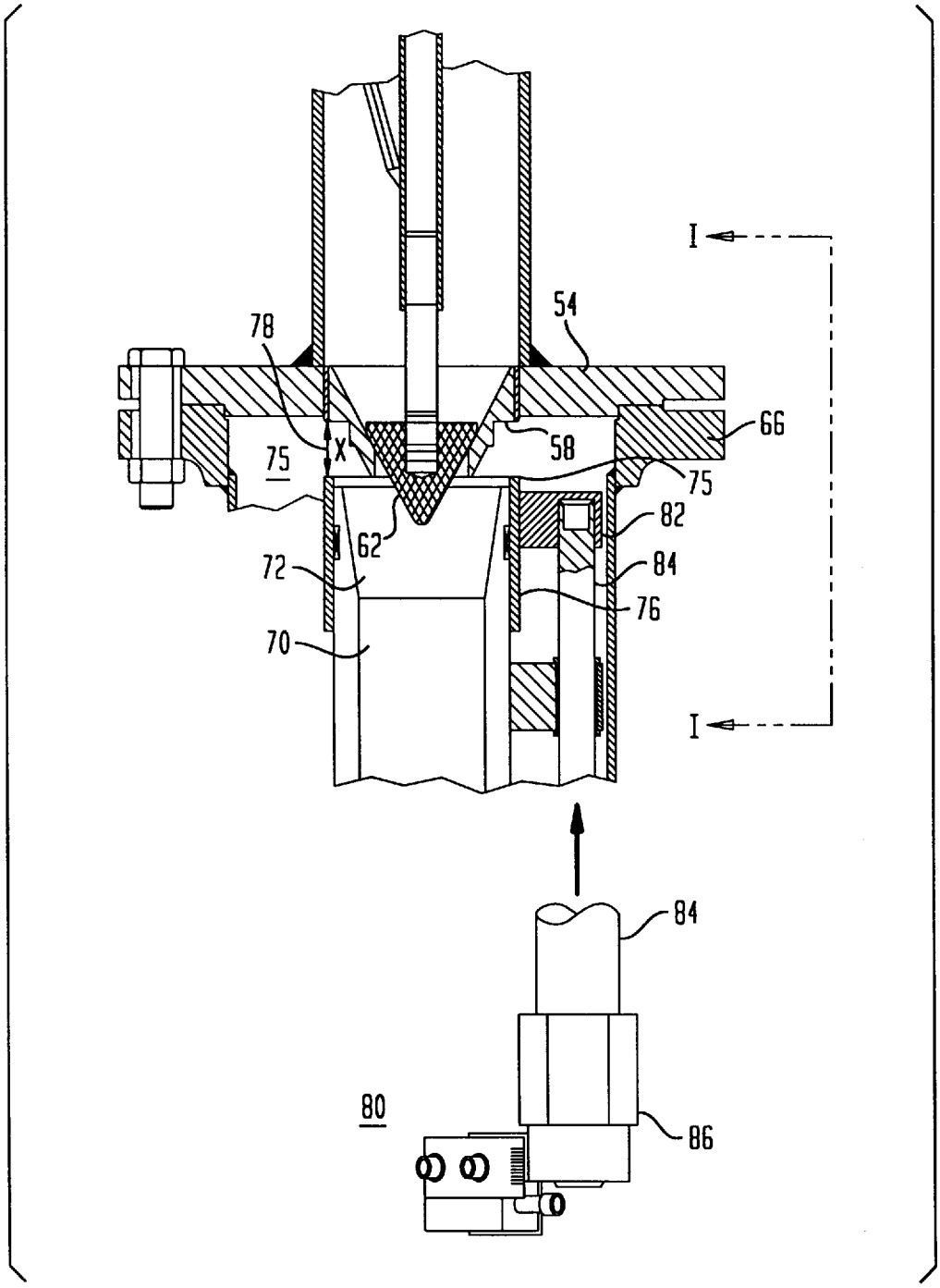
FIG. 3 is an enlarged elevational and partially exploded view of the collar area indicated as I—I in FIG. 2.

Referring to FIG. 3, a collar member 76 is circumferentially mounted on mixing tube 70, preferably about the outer diameter, so as to form a circumferential gap 78 between nozzle end 58 of first housing 54 and the upper edge 75 of collar member 76. A shown in FIG. 2, second actuator means 80 located exterior to second housing 66 is provided for controlling the width of gap 78 by varying the axial movement of collar 76 toward or away from nozzle end 58 so as to control the size of gap 78 between nozzle end 58 and mixing tube 70, as well controlling the pressure of the second fluid 52 introduced into mixing tube 70 through second fluid supply inlet 68.

The second actuator means 80, indicated in both FIGS. 2 and 3, further comprises a boss 82 which is preferably mounted on the circumference of collar member 76, and an adjustment rod 84 which extends outward through second housing 66 and is coupled to boss 82, and mounted parallel to collar member 76 and mixing tube 70 so that adjustment rod 84, boss 82 and collar member 76 move relative to nozzle outlet 62 when second actuator means 80 is adjusted. Second actuator means 80 further comprises a micrometer mixing tube and collar adjuster or microdial 86 (shown enlarged in FIG. 3) for controlling and varying the width of gap 78 to a precise calibration. By adjusting microdial 86 to the predetermined width calibration, adjustment rod 84 is caused to rotate thus moving collar member 76 in the desired direction towards or away from nozzle outlet 62. It should be understood that although collar 76 is shown on the outside diameter of mixing tube 70, collar 76 may be located on the inside diameter of mixing tube 70.

Figure 4:
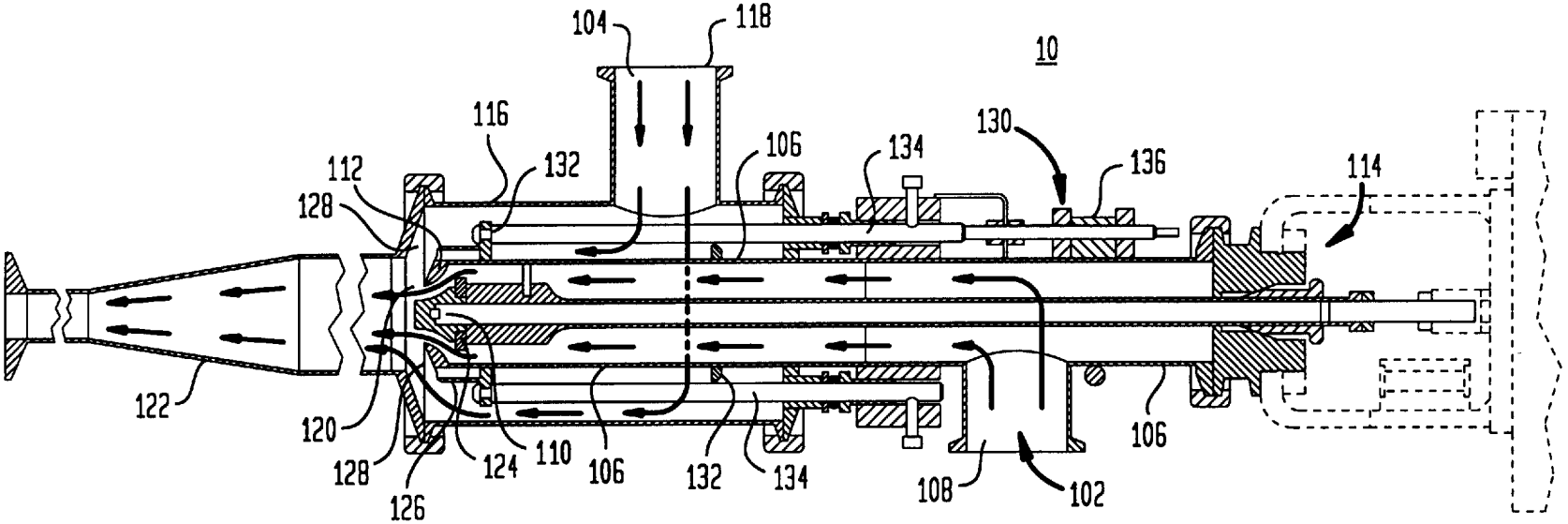
FIG. 4 is an elevational cross section of a second embodiment of the dual actuator mixing jet cooker of the present invention having an axially movable collar mounted on the steam jet nozzle extension for controlling the gap between the steam jet nozzle extension and the mixing tube.

FIG. 4 illustrates a second embodiment of the dual actuator mixing jet cooker 10 of the present invention for mixing a first fluid 102 with a second fluid 104. The cooker 10 of the second embodiment comprises a first housing 106 having a first fluid supply inlet 108 and a first nozzle outlet 110 at nozzle end 112 of first housing 106. A first actuator means 114 is provided for controlling the exit pressure of first fluid 102 when it exits from nozzle outlet 110. A second housing 116 extends coaxial with a portion of first housing 106 and includes a second fluid supply inlet 118 and a second fluid nozzle outlet 120. A stationary mixing tube assembly 122 is coupled to first nozzle outlet 110 and second fluid nozzle outlet 120 and is secured to second housing 116, such that first and second fluids 102, 104 are mixed therein. A valve stem closure seal 124 is circumferentially disposed on mixing tube assembly 122 proximate second fluid nozzle outlet 120. Valve stem closure seal 124 is preferably a drip tight seal such as a poppet seal ring, however a leakable type seal may be utilized as well. A collar member 126 is circumferentially mounted around first nozzle outlet 110 of first housing 106, and preferably about its outer diameter, so as to form a circumferential annulus or gap 128 between mixing tube assembly 122 and collar member 126. A second actuator means 130 located exterior to second housing 116 is provided for axially moving collar member 126 toward or away from mixing tube assembly 122 so as to control the spacing of gap 128 between collar member 126 and mixing tube assembly 122, as well as for controlling the pressure of the second fluid 104 introduced into mixing tube assembly 122.

Second actuator means 130 further comprises a mixing tube adjustment cage 132 mounted on the circumference of collar member 126. An adjustment rod 134 extends outward through second housing 116 at an end opposite mixing tube assembly 122 and is coupled to adjustment cage 132 and mounted parallel to collar member 126 and to first housing 106 so that adjustment of second actuator means 130 causes adjustment cage 132, adjustment rod 134 and collar member 126 to be moved relative to nozzle outlet 110 and to mixing tube assembly 122. As shown in FIG. 4, second actuator means 130 further comprises a micrometer mixing tube and collar adjuster or microdial 136, similar in function to microdial shown enlarged in FIG. 3, for controlling and varying the width of gap 128 to a precise calibration. By adjusting microdial 136 to the predetermined width calibration, adjustment rod 134 rotates collar member 126 in the desired direction so as to widen or narrow gap 128.

Figure 5:
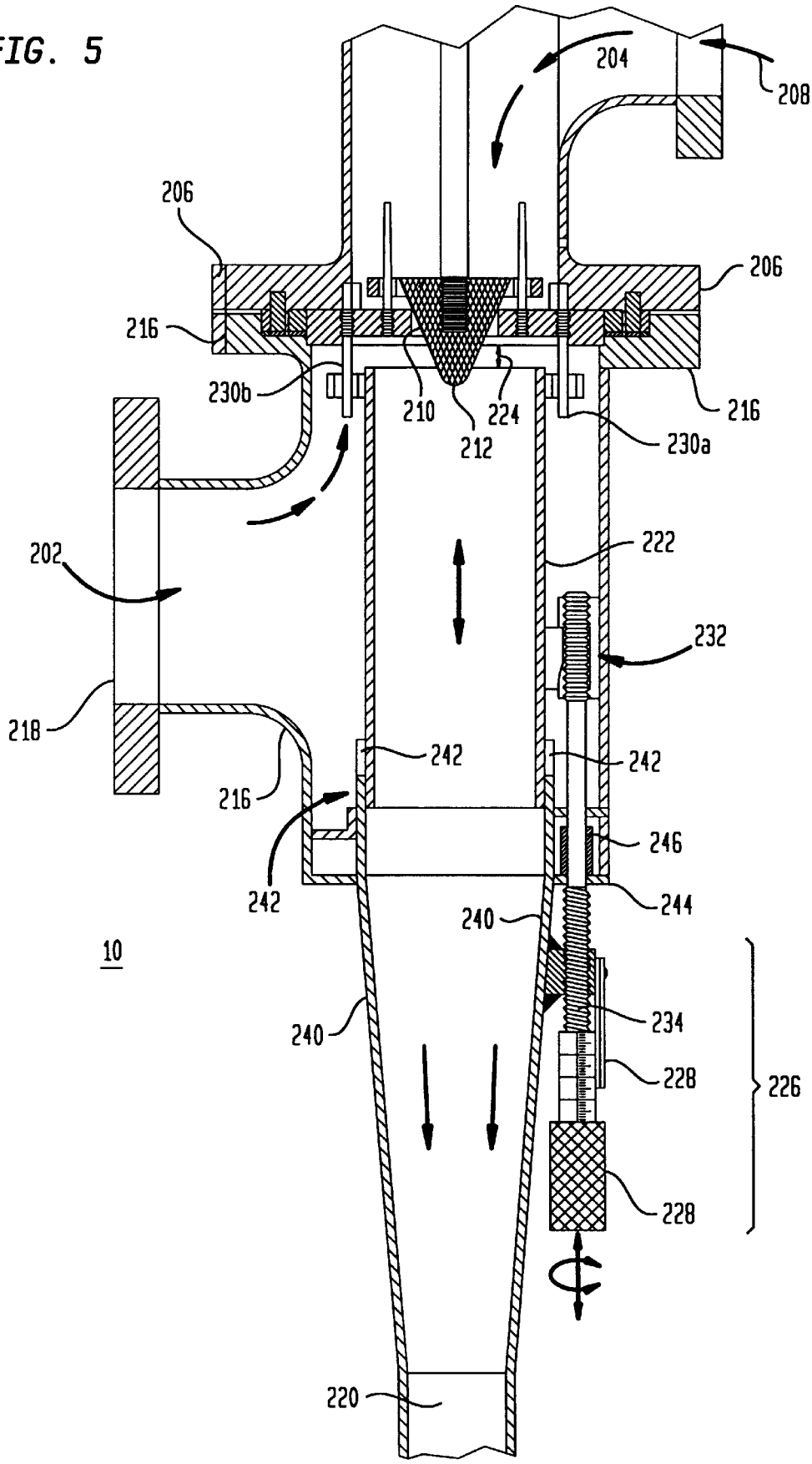
FIG. 5 is an elevational cross section of a third embodiment of the present invention having a movable mixing tube and an actuator apparatus for moving the mixing tube, the actuator apparatus mounted external to the mixing jet cooker housing.

FIG. 5 illustrates a third embodiment of the dual actuator mixing jet cooker 10 of the present invention for mixing a first fluid 202 with a second fluid 204. The cooker 10 of the third embodiment comprises a first housing 206 having a first fluid supply inlet 208 and a first nozzle outlet 210 at nozzle end 212 of first housing 206. A first actuator means (not shown) is provided for controlling the exit pressure of first fluid 204 when it exits from nozzle outlet 210. A second housing 216 is matingly engaged with first housing 206 and includes a second fluid supply inlet 218 and a second fluid nozzle outlet 220. An axially slidable mixing tube 222 is disposed within second housing 216 with a portion of sliding mixing tube 222 mounted within conical reducer 240, such that first and second fluids 202, 204 are mixed therein. A bearing 242 is provided at the interface of the sliding mixing tube 222 and the conical reducer 240, the bearing 242 advantageously fabricated from a Teflon coating or Teflon coated ring. A circumferential annulus or gap 224 exists between mixing tube 222 and nozzle end 212 of first housing 206. A second actuator means 226 located exterior to second housing 216 is provided for axially sliding mixing tube 222 within second housing 216 so as to control the size of gap 224, as well as for controlling the pressure of the second fluid 202 introduced into mixing tube assembly 222. By providing the mixing tube 222 inside second housing 216, the need for sliding high friction external seals to ambient is eliminated as well as flat sliding seals that are required when a mixing tube boss protrudes through the housing.

Second actuator means 226 further comprises a mixing tube adjustment cage 232 mounted on the circumference of second housing 216. An adjustment rod 234 extends outward through second housing 216 at point 244 and is coupled to adjustment cage 232 and mounted parallel to slidable mixing tube 222 in second housing 216 so that adjustment of second actuator means 226 causes adjustment cage 232, adjustment rod 234 and slidable mixing tube 222 to slide axially within second housing 216 relative to nozzle outlet 210. Similar to the actuator shown in FIG. 4, second actuator means 226 further comprises a micrometer mixing tube and collar adjuster or microdial 228, similar in function to microdial shown enlarged in FIG. 3, for controlling and varying the width of gap 224 to a precise calibration. By adjusting microdial 228 to the predetermined width calibration, adjustment rod 234 slides mixing tube 222 in the desired direction so as to widen or narrow gap 224. A plurality of bearings and guide pins facilitate and control the sliding of mixing tube within second housing 216. As shown in FIG. 5, an O-ring seal and a bearing 246 is utilized to seal and guide the adjustment rod 234 as it protrudes out of second housing 216. In this way, the mixing tube 222 does not have to be provided with a high friction seal to ambient. Moreover, the only seal to the ambient pressure is at the protrusion of guide rod 234 from the second housing 216.

With reference again to FIG. 2, when cooker 10 is used in a production process, a slurry mixture 52 first enters the cooker 60 via second fluid supply inlet 60. After entering cooker 10, slurry 52 flows into mixing tube 70 where it interacts and mixes with steam 50 provided by first actuator 64 and which enters mixing tube 70 via nozzle outlet 62 of nozzle end 58 of first housing 54. Depending upon the composition of the slurry 52 passing within mixing tube 70 and the amount of steam being injected into mixing tube 70, gap 78 is adjusted using a micrometer mixing tube and collar adjuster or microdial 86, which in turn causes adjustment rod 84 and boss 82 to move collar 76 on mixing tube 70 towards or away from nozzle outlet 62 of first housing 54. The second embodiment illustrated in FIG. 4, although comprised of additional elements, is structurally and functionally analogously to the first embodiment. However, a difference is that collar member 126 in the second embodiment is mounted around nozzle outlet 110 of first housing 106 to control the spacing of gap 128 between collar member 126 and mixing tube assembly 122, as opposed to the first embodiment where collar member 76 is mounted on entry end 72 of mixing tube 70. Additionally, as illustrated in FIG. 4, the second embodiment includes adjustment cage 132 as an additional element of the second actuator means 130. Adjustment cage 132 serves to assist in the movement of collar member 126 and although the first embodiment illustrated in FIGS. 2 and 3 do not include an adjustment cage 132, an adjustment cage 132 may optionally be added to the device of the first embodiment.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto.

It is to be understood that the drawings are not necessarily drawn to scale, but that they are merely conceptual in nature.

What is claimed is:

1. A fluid mixing apparatus for mixing a first fluid with a second fluid, said apparatus comprising:

an upper housing having a first fluid supply inlet and a first fluid nozzle outlet at a nozzle end of said first housing;

first actuator means for controlling the exit pressure of said first fluid exiting from said nozzle outlet;

a lower housing coupled to said nozzle end of said upper housing, said lower housing having a second fluid supply inlet and a second fluid nozzle outlet;

an axially movable mixing tube for mixing the first and second fluids, said mixing tube disposed within said lower housing and coupled to said lower housing;

a drive rod axially mounted to said mixing tube, said drive rod extending axially through said lower housing and having first and second ends, said first end connected to said axially movable mixing tube and disposed within said lower housing and said second end extending outside said lower housing;

seal means coupled to said lower housing and radially surrounding said drive rod at a point between said first and second ends of said drive rod for sealing said lower housing from ambient pressure; and second actuator means mounted external to said lower housing and coupled to said drive rod for turning said drive rod and moving said mixing tube so as to control the spacing of the gap between said nozzle end of said upper housing and said mixing tube thereby regulating the pressure of the second fluid introduced into said mixing tube.

2. The fluid mixing apparatus of claim 1, wherein said second actuator means further comprises a calibrated microdial.

3. The fluid mixing apparatus of claim 1, wherein said drive rod is rotatable about an axis of rotation substantially parallel to said mixing tube.

4. The fluid mixing apparatus of claim 1, wherein said second end of said drive rod is threaded and is matingly attached to said lower housing.

5. The fluid mixing apparatus of claim 4, wherein said first end of said drive rod is fixedly secured to said mixing tube so that when said drive rod is rotated, said drive rod and said mixing tube move in tandem.

6. The fluid mixing apparatus of claim 1, wherein said first end of said drive rod is threaded and matingly attached to said mixing tube.

7. The fluid mixing apparatus of claim 6, wherein said second end of said drive rod is secured to said second housing so that when said drive rod is rotated, said mixing tube axially moves in relation to said drive rod.

8. The fluid mixing apparatus of claim 1, wherein said seal means is an O-ring seal.

9. The fluid mixing apparatus of claim 1, wherein said seal means further includes a bearing fabricated from a Teflon material.

10. The fluid mixing apparatus of claim 1, wherein said second actuator means further comprises a knurled adjustment screw.

11. The fluid mixing apparatus of claim 1, wherein said mixing tube is disposed within the inner circumference of said lower housing mixing tube.

12. The fluid mixing apparatus of claim 11, further comprising:

a conical reducer, matingly engaged with said lower housing so as to form an interface between said reducer and said mixing tube; and a bearing mounted at said interface of said mixing tube and said reducer.

13. The fluid mixing apparatus of claim 12, wherein said bearing is fabricated from a Teflon material.

14. The fluid mixing apparatus of claim 11, wherein the interface of said mixing tube and said reducer is within the lower housing.

15. A fluid mixing apparatus for mixing a first fluid with a second fluid, said apparatus comprising:

a first housing having a first fluid supply inlet and a first fluid nozzle outlet at a nozzle end of said first housing;

first actuator means for controlling the exit pressure of said first fluid exiting from said nozzle outlet;

a second housing coupled to said nozzle end of said first housing, said second housing having a second fluid supply inlet, a second fluid nozzle outlet and a reducer section;

an axially movable mixing tube for mixing the first and second fluids, said mixing tube disposed within said second housing and coupled to said reducer section;

a drive rod axially mounted to said mixing tube, said drive rod extending axially through said second housing; and second actuator means mounted external to said second housing and coupled to said mixing tube for axially sliding said drive rod and said mixing tube within said second housing so as to control the spacing of the gap between said nozzle end of said first housing and said mixing tube within said second housing thereby regulating the pressure of the second fluid introduced into said mixing tube.

* * * * *